United States Patent [19]

Thomas

[11] Patent Number: 4,964,682

[45] Date of Patent: Oct. 23, 1990

[54] MULTIPLE PURPOSE FURNITURE UNIT

[76] Inventor: Anthony P. Thomas, 1037 Lafayette Ct., Collinsville, Ill. 62234

[21] Appl. No.: 419,024

[22] Filed: Oct. 10, 1989

[51] Int. Cl.[5] ..... A47B 47/00

[52] U.S. Cl. ..... 312/138.1; 108/111

[58] Field of Search ..... 108/111, 108; 312/138.1, 281; 211/189, 190

[56] References Cited

U.S. PATENT DOCUMENTS

| | | | |
|---|---|---|---|
| 2,646,330 | 7/1953 | Swainbank | 312/281 X |
| 4,120,549 | 10/1978 | Bureau | 312/281 X |
| 4,136,623 | 1/1979 | Dickson | 108/111 |
| 4,709,640 | 12/1987 | Jouanin | 108/111 X |
| 4,818,043 | 4/1989 | Borgen | 312/138.1 |

*Primary Examiner*—Joseph Falk

[57] ABSTRACT

A multiple purpose furniture unit includes a bottom, a panel for placing on the bottom and perpendicular to the bottom, the panel having a first side and a second side, a first post for placing on the bottom and perpendicular to the bottom, the first post positioned opposite the first side, a second post for placing on the bottom and perpendicular to the bottom, the second post positioned opposite the second side, and first shelf members connected to the first side and the first post in a spaced apart relationship from the bottom. The unit also includes a second shelf member connected to the second side and the second post, the second shelf member being spaced above the bottom, a desk top connected to the second shelf member and extending away from the second shelf member, and a top connected to the panel and the first post, the top positioned above the topmost one of the first shelf members.

16 Claims, 2 Drawing Sheets

FIG. 1.
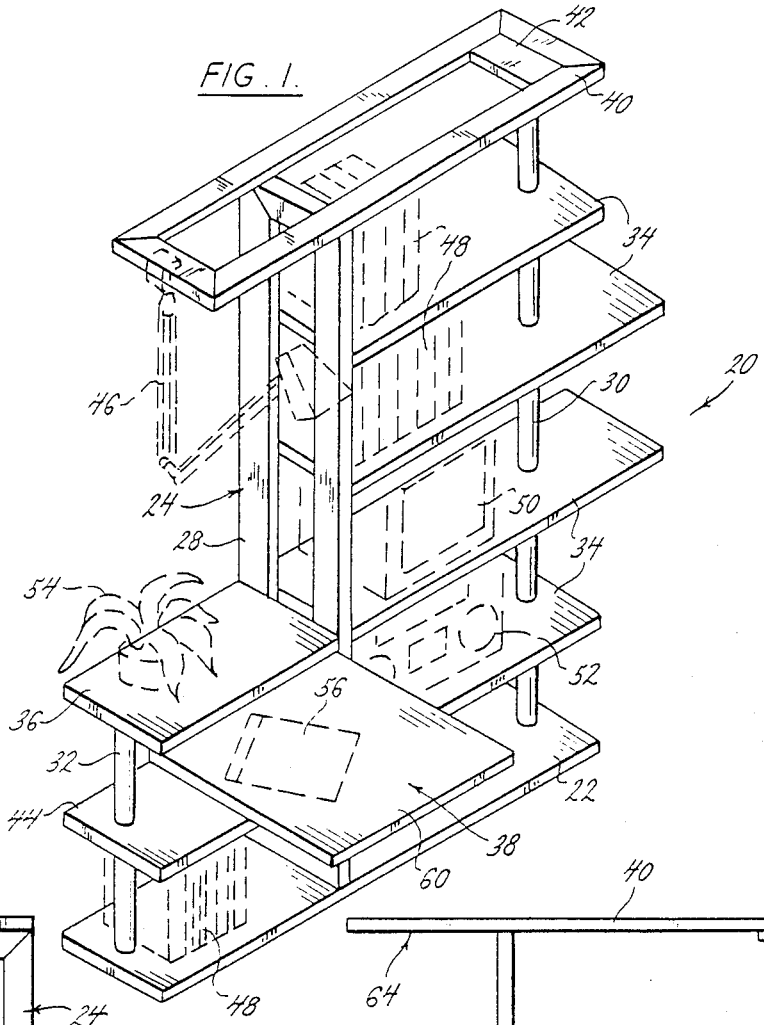
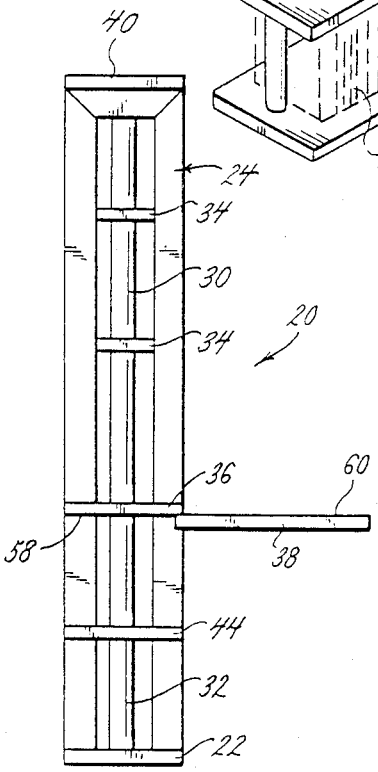
FIG. 2.
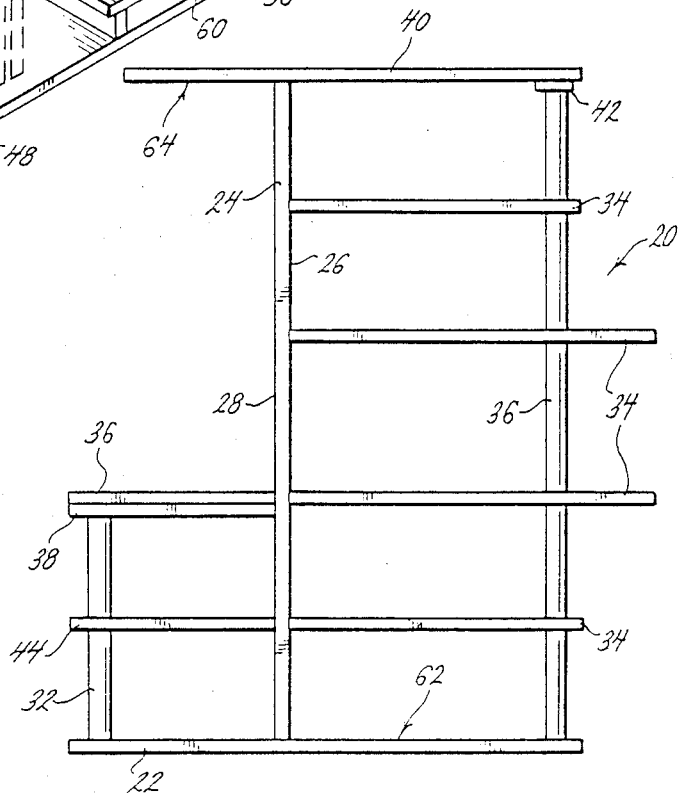
FIG. 3.

FIG. 4.
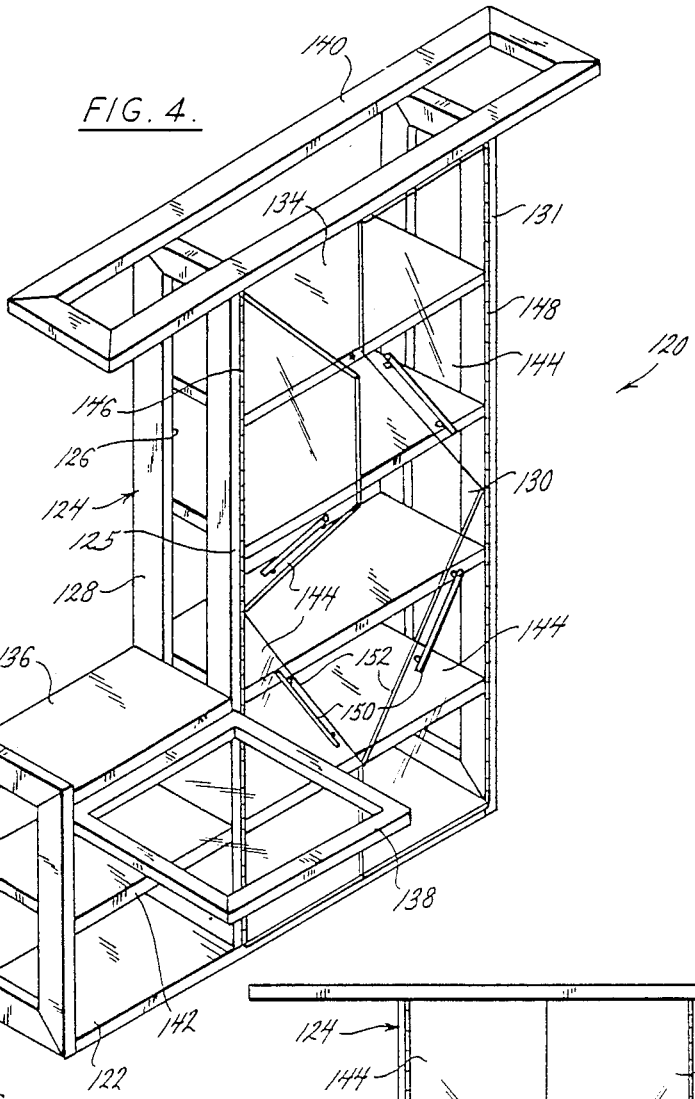
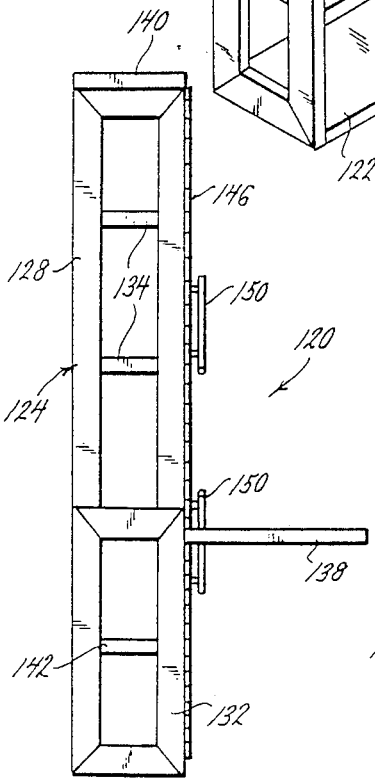
FIG. 5.
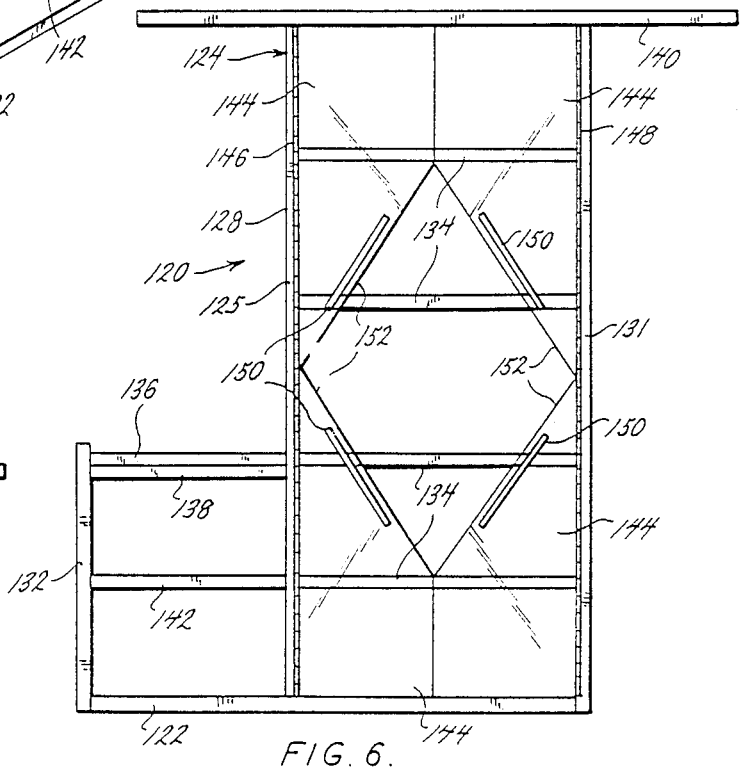
FIG. 6.

MULTIPLE PURPOSE FURNITURE UNIT

BACKGROUND OF THE INVENTION

This present invention relates to a multiple purpose furniture unit for use in an area having limited space.

For many years there has been a demand for a multiple purpose furniture unit that can be used in confined spaces, such as apartments or dormitories. The multiple purpose furniture unit must be capable of providing storage for various different objects, for example, stereo components, televisions, VCRs, books, plants, and lamps. Additionally, a writing surface should be included in the unit.

There are a number of prior multiple purpose furniture units examples of which are disclosed in U.S. Pat. Nos. 3,338,648; 3,537,769; 3,748,010; and 3,936,110. Many of these prior units were of complicated design and construction and thus were expensive. Some of these prior units were difficult to move in the space within which they were placed.

SUMMARY OF THE INVENTION

Among the objects of the present invention is the provision of a multiple purpose furniture unit which is of simple construction for low cost and highly reliable operation; the provision of such a unit that can be easily used in confined or limited areas; and the provision of such a unit that can be quickly and easily moved within a limited area.

A multiple purpose furniture unit of the present invention includes a bottom, a panel for placing on the bottom and perpendicular to the bottom, the pannel having a first and a second side, a first post for placing on the bottom and perpendicular to the bottom, the first post positioned opposite to the first side, a second post for placing on the bottom and perpendicular to the bottom, the second post positioned opposite to the second side, and a first shelf member connected to the first side and the first post in a spaced apart relationship from the bottom. The unit also includes a second shelf member connected to the second side and the second post, the second shelf member being spaced above the bottom, a desk top connected to the second shelf member and extending away from the second shelf member, and a top connected to the panel and the first post spaced above the topmost one of the first shelf members.

Another form of the multiple purpose furniture unit of the present invention includes a bottom, a rectangular shaped member for placing on the bottom and perpendicular to the bottom, the rectangular member having a first and a second side and a front edge, a first panel for placing on the bottom and perpendicular to the bottom, the first panel positioned opposite to the first side and having a front edge, a second panel for placing on the bottom and perpendicular to the bottom, the second panel positioned opposite to the second side, and a first shelf member connected to the first side and the first panel in a spaced apart relationship from the bottom. The unit also includes a second shelf member connected to the second side and the second panel, the second shelf member being spaced above the bottom, a desk top connected to the second shelf member and extending away from the second shelf member, a top connected to the rectangular member and the first panel spaced above the topmost one of the first shelf members, and door members hingedly attached to the front edges.

Other objects and features will be in part apparent and in part pointed out hereinafter.

BRIEF DESCRIPTION OF THE DRAWINGS

FIG. 1 is a perspective view of a multiple purpose furniture unit of the present invention;

FIG. 2 is a front plan view of the multiple purpose furniture unit of FIG. 1;

FIG. 3 is a side view of the multiple purpose furniture unit taken from the left side of FIG. 1;

FIG. 4 is a perspective view of a second embodiment of the multiple purpose furniture unit of the present invention;

FIG. 5 is a front plan view of the multiple purpose furniture unit of FIG. 4; and FIG. 6 is a side view of the multiple purpose furniture unit taken from the left side of FIG. 4.

Corresponding reference characters indicate corresponding parts throughout the several views of the drawings.

DETAILED DESCRIPTION OF THE PREFERRED EMBODIMENTS

A multiple purpose furniture unit of the present invention, indicated generally as 20 in the drawings, is shown in FIGS. 1–3. The unit 20 includes a bottom 22 which is adapted to be placed on the ground or floor when unit 20 is in use. The bottom 22 is rectangular in shape. A rectangular member or panel 24 is positioned on the bottom 22 and perpendicular to the bottom 22. The panel 24 has a first side 26 and a second side 28. A first post 30 is placed on the bottom 22 and is perpendicular to the bottom 22. The first post 30 is positioned opposite the first side 26. A second post 32 is also placed on the bottom 22 and perpendicular to the bottom 22. The second post 32 is positioned opposite the second side 28.

Shelf members 34 are connected to the first side 26 of the panel 24 and the first post 30. The shelf members 34 are rectangular in shape. The shelf members 34 are spaced apart from each other and the bottom 22. A second shelf member 36 is connected to the second side 28 of the panel 24 and the second post 32. The second shelf member 36 is spaced above the bottom 22. The second shelf member 36 is rectangular in shape.

A desk top 38 is connected to the second shelf member 36 and extends away from the second shelf member 36. The desk top 38 is rectangular in shape. A top 40 is connected to and between the panel 24 and the first post 30. The top 40 is spaced above the topmost one of the shelf members 34. The top 40 is hollow at its center and also includes a panel 42 which receives the top of the first post 30.

The unit 20 also includes a third shelf member 44 connected to the second side 28 and the second post 32. The third shelf member 44 is positioned between the bottom 22 and the second shelf member 36. The third shelf member 44 is rectanugular in shape.

The lengths of the shelf members 34 vary and some of the lengths of the shelf members 34 extend past the first post 30. The shelf members 34 are also adjustable relative to the first side 26 and the first post 30. For example, the first side 26 and the first post 30 may each include a series of holes (not shown) for pins (not shown) to be inserted. The bottom side of the shelf members 34 may rest on the pins. The lengths of shelf members 34 are greater than the lengths of the second shelf member 36 and the third shelf member 44. The length of the second shelf member 36 is substantially equal to the length of the desk top 38.

FIG. 1 illustrates the placement of various different objects in the unit 20. For example, a lamp 46 (shown in phantom) may be clamped to the top 40. Books 48 (shown in phantom) are shown stored on the shelf members 34 and the bottom 22. A television 50 (shown in phantom) is placed on one of the shelf members 34. The shelf members 34 may be adjusted to be able to accommodate various sizes of televisions. A stereo 52 (also shown in phantom) is placed on one of the shelf members 34. A plant 54 (shown in phantom) is placed on the second shelf member 36. Also, a pad of paper 56 (shown in phantom) is on the desk top 38.

A side view of the unit 20 is shown in FIG. 2. The second shelf member 36 has a bottom side 58 and the desk top 38 has a top side 60. The top side 60 is connected to the bottom side 58. Also, the second post 32 is connected to the bottom side 58.

FIG. 3 shows a front view of the unit 20. The bottom 22 includes a top side 62 and the first and second posts 30 and 32 are connected to the top side 62. The top 40 includes a bottom side 64 and the panel 24 is connected to the bottom side 64. The panel 42 is also shown connected to the first post 30.

A second embodiment of the multiple purpose furniture unit of the present invention is shown in FIGS. 4–6 and indicated generally as 120 in the drawings. The unit 120 includes a bottom 122 which is adapted to be placed on the ground or floor when unit 120 is in use. The bottom 122 is rectangular in shape. A rectangular member 124 is positioned on the bottom 122 and perpendicular to the bottom 122. The member 124 has a first side 126 and a second side 128. The member 124 also has a front edge 125. A first panel 130 is placed on the bottom 122 and is perpendicular to the bottom 122. The first panel 130 is positioned opposite the first side 126. The first panel 130 has a front edge 131. A second panel 132 is also placed on the bottom 122 and perpendicular to the bottom 122. The second panel 132 is positioned opposite the second side 128.

Shelf members 134 are connected to the first side 126 of the member 124 and the first panel 130. The shelf members 134 are rectangular in shape. The shelf members 134 are spaced apart from each other and the bottom 122. A second shelf member 136 is connected to the second side 128 of the member 124 and the secnd panel 132. The second shelf member 136 is spaced above the bottom 122. The second shelf member 136 is rectangular in shape.

A desk top 138 is connected to the second shelf member 136 and extends away from the second shelf member 136. The desk top 138 is rectangular in shape. A top 140 is connected to and between the member 124 and the first panel 130. The top 140 is spaced above the topmost one of the shelf members 134. The top 140 is hollow at its center.

The unit 120 also includes a third shelf member 142 connected to the second side 128 and the second panel 132. The third shelf member 142 is positioned between the bottom 122 and the second shelf member 136. The third shelf member 142 is rectangular in shape.

The lengths of the shelf member 134 are equal. The shelf members 134 are also adjustable relative to the first side 126 and the first panel 130. For example, the first side 126 and the first panel 130 may each include a series of holes (not shown) for pins (not shown) to be inserted. The bottom side of the shelf members 134 may rest on the pins. The lengths of shelf members 134 are greater than the lengths of the second shelf member 136 and the third shelf member 142. The length of the second shelf member 136 is substantially equal to the length of the desk top 138.

The unit 120 also includes door members 144. The door members 144 are hingedly attached to the front edges 125 and 131 by means of hinges 146 and 148, respectively. The door members 144 include handles 150 for opening and closing the door members 144. Each of the door members 144 ccmprises a pane of glass. Additionally, the desk top 138 includes a pane of glass.

FIG. 5 shows a side view of the unit 120. The desk top 138 extends away from the unit 120. The handles 150 also extend away from the door members 144.

A front view of the unit 120 is illustrated in FIG. 6. The door members 144 have an angled section 152. The handles 150 are attached to the door members 144 along the angled section 152.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A multiple purpose furniture unit comprising:

a bottom having a top surface and a bottom surface, the bottom surface for resting on a floor, the bottom of generally rectangular shape;

a panel for placing on the top surface of the bottom and perpendicular to the top surface of the bottom, the panel having a first side and a second side, a bottom edge and a top edge, the bottom edge being placed on the top surface;

a first post for placing on the top surface of the bottom and perpendicular to the top surface of the bottom, the first post positioned opposite the first side, the first post being generally circular in cross section and having a top end;

a second post for placing on the top surface of the bottom and perpendicular to the top surface of the bottom, the second post positioned opposite the second side, the second post being generally circular in cross section and being smaller in height than the first post;

a first shelf member connected to the first side of the panel and the first post in a spaced apart relationship above the top surface of the bottom, the first shelf member being rectangular in shape;

a second shelf member connected to the second side of the panel and the second post, the second shelf member being spaced above the top surface of the bottom, the second shelf member being rectangular in shape and having a bottom surface and a front edge;

a desk top being generally rectangular in shape and having a top surface and the top surface of the desk top being connected to the bottom surface of the second shelf member at the front edge and extending away from the second shelf member; and a top having a top side and a bottom side, the top connected to the top edge of the panel and the top end of the first post, the top positioned above the first shelf members.

2. The unit of claim 1 further comprising a third shelf member connected to the second side and the second post, the third shelf member positioned between the bottom and the second shelf member.

3. The unit of claim 1 wherein the length of the first shelf member extends past the first post.

4. The unit of claim 1 wherein the length of the second shelf member is substantially equal to the length of the desk top.

5. The unit of claim 1 wherein the second post is connected to the bottom surface of the second shelf member.

6. The unit of claim 1 wherein the lengths of the first shelf members are greater than the length of the second shelf member.

7. The unit of claim 1 wherein the first shelf member is adjustable to relative to the first side and the first post.

8. The unit of claim 1 wherein the first and second posts are connected to the top surface of the bottom.

9. The unit of claim 1 wherein the top includes a panel and the first post is connected to the panel.

10. A multiple purpose furniture unit comprising:

a bottom having a top surface and a bottom surface, the bottom surface for resting on a floor, the bottom of generally rectangular shape;

a rectangular member for placing on the top surface of the bottom and perpendicular to the top surface of the bottom, the member having a first side and a second side, a bottom edge and a top edge, the bottom edge being placed on the top surface, the member including a front edge;

a first panel for placing on the bottom and perpendicular to the bottom, the first panel positioned opposite the first side, the first panel including a front edge;

a second panel for placing on the bottom and perpendicular to the bottom, the second panel positioned opposite the second side;

a first shelf member connected to the first side of the member and the first panel in a spaced apart relationship above the top surface of the bottom, the first shelf member being rectangular in shape;

a second shelf member connected to the second side of the member and the second panel, the second shelf member being spaced above the top surface of the bottom, the second shelf member being rectangular in shape and having a bottom surface and a front edge;

door members;

means for hingedly attaching the door members to the front edges;

a desk top being generally rectangular in shape and having a top surface and the top surface of the desk top being connected to the bottom surface of the second shelf member at the front ends and extending away from the second shelf member; and a top having a top side and a bottom side, the top connected to the top edge of the member and the top end of the first panel, the top positioned above the first shelf member.

11. The unit of claim 10 further comprising a third shelf member connected to the second side and the second panel, the third shelf member positioned between the bottom and the second shelf member.

12. The unit of claim 10 wherein the door members comprise a pane of glass with each of the panes including a handle for opening and closing the door members.

13. The unit of claim 10 wherein the length of the second shelf member is substantially equal to the length of the desk top.

14. The unit of claim 13 wherein the length of the first shelf member is greater than the length of the second shelf member.

15. The unit of claim 10 wherein the desk top comprises a pane of glass.

16. The unit of claim 10 wherein the first shelf member is adjustable relative to the first side and the first panel.

* * * * *